United States Patent [19]

Wellington et al.

[11] Patent Number: 4,742,704

[45] Date of Patent: May 10, 1988

[54] HYDRAULIC JEWELRY PRESS

[75] Inventors: Robert Wellington; Louis Bell, both of Albuquerque, N. Mex.

[73] Assignee: Rio-Grande-Albuquerque, Inc., Albuquerque, N. Mex.

[21] Appl. No.: 33,836

[22] Filed: Apr. 3, 1987

[51] Int. Cl.[4] ..... B21D 22/10

[52] U.S. Cl. ..... 72/57; 72/54; 72/446; 72/448; 72/465; 29/421 R

[58] Field of Search ..... 72/54, 56, 57, 60, 63, 72/446, 448, 465, 701; 29/421 R

[56] References Cited

U.S. PATENT DOCUMENTS

| | | | |
|---|---|---|---|
| 2,606,516 | 8/1952 | Raynes | 72/57 |
| 3,094,956 | 6/1963 | Pauls | 72/54 |
| 3,180,776 | 4/1965 | Hessel | 72/63 |
| 3,230,869 | 1/1966 | Wilkins | 72/446 |
| 4,658,618 | 4/1987 | Hellgren | 72/54 |

OTHER PUBLICATIONS

ASEA Metallurgy Pamphlet AQ 30,-103E Edition 2, 9/84, pp. 8 & 9.

*Primary Examiner*—David Jones

*Attorney, Agent, or Firm*—Basile and Hanlon

[57] ABSTRACT

A highly compact, bench mounted, fast cycle, high tonnage and soft punch type of hydraulic press designed to form thin metal blanks into a wide variety of artifacts such as jewelry. The under surface of the piston incorporates a counterbore containing a resilient urethane forming pad which, under very great pressure applied by the piston, imparts very fine detail, laterally as well as vertically, to the blank being formed into or over the die as the counterbore tightly envelopes the die. A rapid manually operated die shuttling device which provides for one die to be un-loaded and loaded as the blank of the other die is being pressed, and a rapid manually operated hydraulic valve actuating device, in combination with the piston's very short pressing stroke, effect a fast and safe operating cycle.

6 Claims, 2 Drawing Sheets

HYDRAULIC JEWELRY PRESS

BACKGROUND OF THE INVENTION

The invention relates to soft punch type of hydraulic presses utilizing punch-driven rubber pads which compress thin metal blanks into or over hard compositioned dies to form a variety of objects. The main advantage of this type of process is elimination of need for expensive, hard compositioned punch members having the die contour facsimile. Another advantage is retention of fine surface finish of the metal blank, as opposed to finish degradation resulting when hard compositioned punch members are employed.

A main limitation of conventional soft punch presses, which are designed to form large metal blanks, is their inability to provide the great localized forces necessary to impart very fine detail in small blanks. Moreover, the cycle time of these large, very costly presses generally ranges from one to two minutes, mainly because of the great amount of hydraulic fluid which must be pumped to the cylinder under high pressure.

The present invention is specially designed to overcome the aforementioned disadvantages of conventional soft punch presses as applied to the forming of small metal blanks, while still retaining the surface finish preservation attribute of this art. Specifically the present invention is a relatively low cost, highly compact, bench mounted, fast cycle, safe and high tonnage soft punch press, specially designed to impart very fine detail to thin metal blanks.

SUMMARY OF THE INVENTION

The invention comprises a heavy walled hydraulic cylinder directly mounted to a base supported by a housing containing a hydraulic pump. A hydraulically sealed piston is slidably received in the cylinder and normally biassed to its uppermost position in abutment with the cylinder cap by compression springs mounted to the base. A die carrier device is received and guided in a passageway extending through the cylinder adjacent the base; and a valve actuating device is mounted upon the pump. The hydraulic pump forces hydraulic fluid under pressure from the pump into a port in the cylinder cap.

A counterbore in the under surface of the piston contains a resilient urethane forming pad, which under very great pressure applied by the piston, imparts very fine detail to a metal blank supported on a die positioned by the die carrier in the cylinder as the counterbore tightly envelopes the die.

The die carrier incorporates a long carrier plate slidably mounted on the base and having a pair of die nests which accommodate interchangeable dies. A pair of shuttle stop blocks are mounted on the carrier, and a pair of shuttle push pins located behind the stop blocks. A formed metal object is unloaded and a metal blank is loaded in one die as a blank on the other die is being formed by the press. When the pressing function is completed the operator manually shifts the die carrier via a push pin to move the die carrying the newly formed part out of the cylinder and at the same time moving the loaded die into position within the cylinder. The stop blocks on the carrier engage the cylinder wall to limit movement of the die carrier.

The valve actuating device is slidably mounted on the base and carries first and second valve button actuating cams attached to its under surface. A wedge-shaped tab is mounted normal to the upper surface of the actuator. This tab, when a die is located within the cylinder, will slidably enter one of a pair of slots milled across the bottom surface of the bar of the die shuttling device, to bring the die into precise axial alignment with the piston preparatory to valve actuation by the cams, as the valve actuating device is shifted inwardly.

As this shifting is completed the first cam conditions the hydraulic pump to deliver hydraulic fluid from the pump reservoir to the cylinder of the press, while the second cam starts the hydraulic pump drive motor. As the valve actuating device is returned to the out position following the pressing function, the first cam conditions the reservoir to receive fluid exhausted from the press cylinder via force of the piston return springs acting on the piston, while the second cam turns off the pump motor.

Summarizing, the invention's operating cycle is as follows. The operator unloads and loads one die as the metal blank of the other die is being pressed. As the pressing is completed the operator shifts the valva actuating device outwardly to stop the hydraulic motor and permit hydraulic fluid in the press cylinder to return to a compartment within the hydraulic pump. This allows the piston to return to its upward position and thus free the die. The operator then shifts the die shuttling device laterally to exit the die with the formed blank from the press and enter the second die and its un-formed blank into the press. The operator then shifts the valve actuating device inwardly to start the hydraulic motor and permit hydraulic fluid to enter the press to effect the pressing function.

Other objects and features of the invention will become apparent by reference to the following specification and to the drawings.

IN THE DRAWINGS

Figure 1:
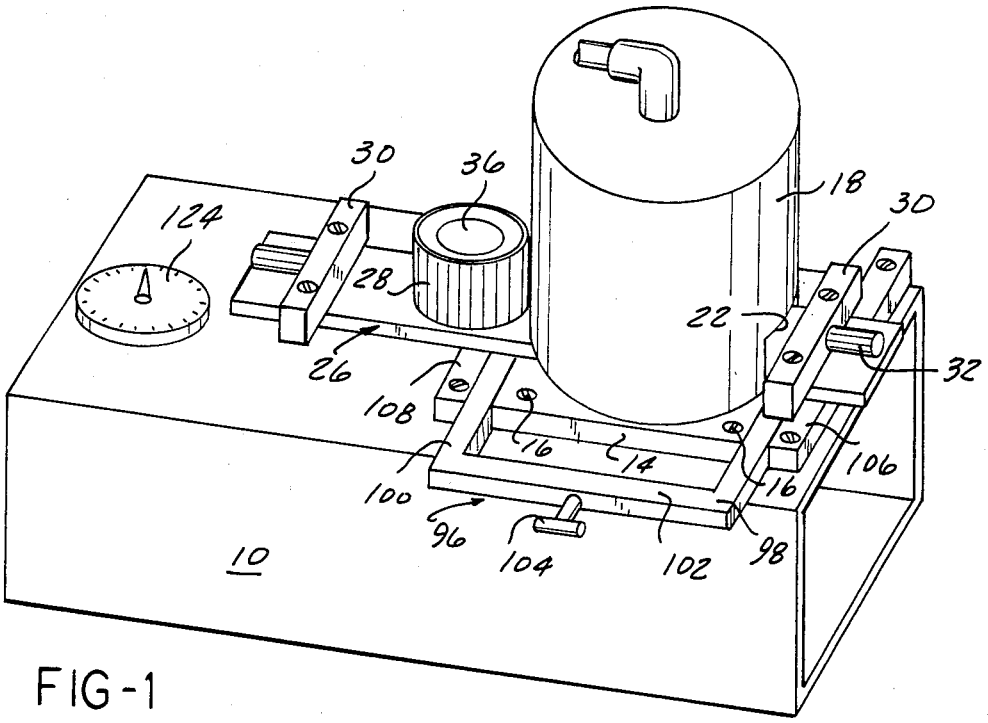
FIG. 1 is a perspective view of a press embodying the present invention.
Figure 2:
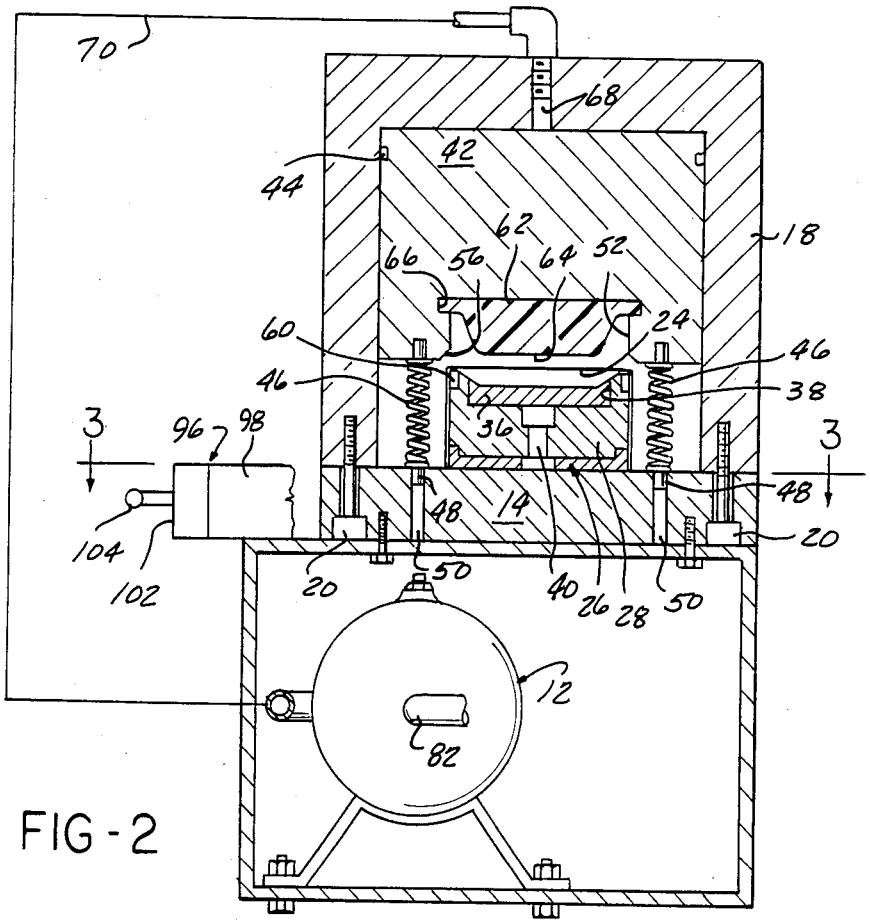
FIG. 2 is a cross sectional view of the press of FIG. 1 taken on a vertical plane at the axis of the hydraulic cylinder.
Figure 4:
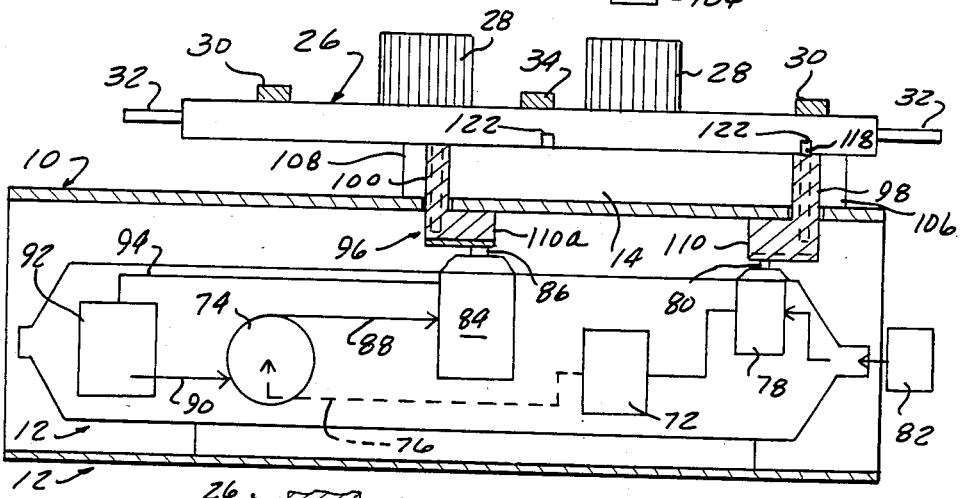
FIG. 4 is a side elevation, partially in cross section, with certain parts omitted, of the lower portion of the press.

Referring first to FIGS. 1 and 2, a press embodying the present invention includes a stationary base designated generally 10 which, in addition to providing a stationary base for the press itself also functions as a housing for a fluid pressure supply source designated generally 12 (FIGS. 2 and 4). A relatively heavy plate 14 is fixedly mounted upon the top of base 10 as by bolts 16 and the cylinder 18 of a hydraulic motor is in turn fixedly secured at its lower end upon plate 14 as by bolts 20 (FIG. 2).

Rectangular openings 22 (FIG. 1) and 24 (FIG. 2) are cut through diametrically opposed portions of the wall of cylinder 18 at the lower end of the cylinder.

A plate-like die carrier or shuttle designated generally 26 is slidably supported upon plate 14 and guided in horizontal sliding movement through the passage through the cylinder 18 defined by openings 22 and 24 by the engagement of the opposite sides of die carrier 26 with the opposed sides of openings 22 and 24. A pair of cylindrical die nests 28, best seen in FIG. 4, are fixedly mounted upon and project upwardly from die carrier 26 at spaced positions on the carrier such that when one of the die nests 28 is located within cylinder 18, the other die nest 28 is at the exterior of the cylinder. Stop blocks 30 are fixedly mounted on the die carrier near each end and project outwardly beyond the opposite sides of the die carrier to engage the wall of cylinder 18 to establish end limits of shuttling movement of the die carrier relative to the cylinder. Push pins 32 are mounted on the outer side of each of stop blocks 30. Carrier 26 is manually shifted to shuttle die nests 28 alternately into and out of cylinder 18. A centrally located protective block 34 (FIG. 4) is fixedly mounted on the top of die carrier 26 to at least partially block the openings 22 or 24 when one of the die nests is within the cylinder.

Referring now particularly to FIGS. 2 and 4, each of die nests 28 carries a die 36 received with a press fit within a counter bore 38 in die nest 28. An opening 40 through die carrier 26 and die nest 28 functions as a die knockout opening for removing dies 36.

Figure 7:
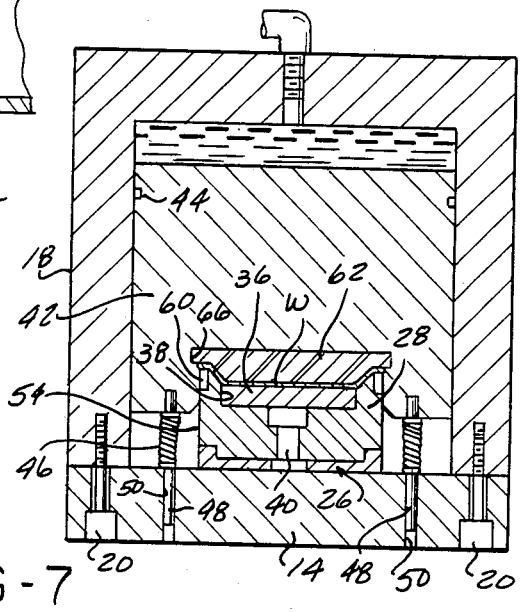
FIG. 7 is a cross sectional view similar to FIG. 2 showing a different stage in the operation of the press.

The upper face of each die 36 is formed with a decorative pattern, not shown, which is to be formed on a blank or workpiece W (FIG. 7). Typically, the workpiece W consists of a disklike blank of relatively thin sheet metal. A blank is manually loaded on top of one of the dies while a previously loaded blank on the other die is being pressed within cylinder 18 by a structure to be described in greater detail below.

Referring now particularly to FIGS. 2 and 7, a piston 42 is slidably mounted within cylinder 18 in sealing engagement with the cylinder wall as by one or more sealing rings 44. Piston 42 is normally biased upwardly to the rest position shown in FIG. 2 by a plurality of compression springs 46 engaged between the lower face of the piston and plate 14 and retained on pins 48 fixedly secured to the piston and slidably received within bores 50 and plate 14.

The lower surface of piston 42 is formed with an upwardly extending counterbore 52 (FIG. 2) having a diameter matched to receive, with a sliding fit, the cylindrical outer side surface 54 of die nests 28, as best seen in FIG. 7. To assist in accurately aligning these last surfaces, the lower end of counterbore 52 in piston 42 is chamfered as at 56 and the upper end of die nest 28 is provided with a moderately resilient urethane seal ring 60.

A forming pad 62 is mounted in the upper end of counterbore 52 and formed with a lower surface 64 (FIG. 2) approximately conformed to the upper face of die 36. Pad 62 is preferably formed of a resilient urethane material and may be retained within recess 52 within a peripheral groove 66 formed at the upper end of counterbore 52.

As noted above, piston 42 is normally biased upwardly within cylinder 18 to the position shown in FIG. 2. Piston 42 is driven downwardly to the position shown in FIG. 7 by supplying fluid under pressure from fluid pressure source 12 to port 68 at the upper end of cylinder 18 via a valve controlled conduit schematically illustrated at 70 in FIG. 2.

Referring now particularly to FIG. 4, fluid pressure supply source 12 may take the form of any of numerous commercially available self contained motor driven pump units. A typical unit of this type is schematically shown in FIG. 4 and includes an air motor 72 operable to drive a pump 74 via a suitable drive connection schematically indicated in broken line at 76. A first on/off valve 78 is provided with a vertically reciprocable actuator 80 normally maintained in an upper position in which flow of air under pressure from an air pressure source 82 is blocked from air motor 72. Upon depression of actuator 80, valve 78 operates to connect air motor 72 to source 82.

A similar two position valve 84 is provided with a vertically reciprocable actuator 86 which when in its normally maintained upper position connects the output conduit 88 of pump 74 to conduit 70 to supply fluid under pressure to conduit 70. The intake 90 of pump 74 is connected to a fluid reservoir 92. When valve actuator 86 is depressed, conduit 70 is disconnected from pump output 88 and connected to fluid reservoir 92 via a conduit 94 to allow fluid within cylinder 18 to be returned to reservoir 92 as piston 42 is returned to its rest position by springs 46.

Figure 3:
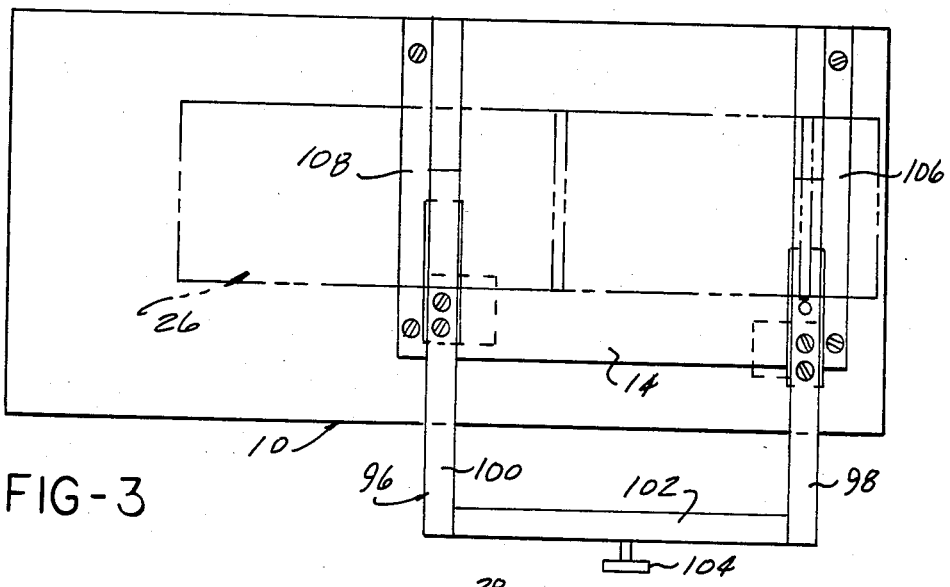
FIG. 3 is a cross sectional view taken on the line 3—3 of FIG. 2.

Actuation of valves 78 and 84 is controlled and coordinated by a manually operated valve actuator assembly designated generally 96. Assembly 86 takes the form of a generally U-shaped frame constituted by a pair of parallel arms 98, 100 rigidly interconnected to each other by a cross member 102. A knob 104 is fixedly mounted on cross member 102 to facilitate pushing and pulling assembly 96 from and to its normal rest position shown in FIGS. 1, 2 and 3. Arms 98 and 100 respectively slidably engage opposed sides of plate 14 and are held in sliding engagement with the plate by slide blocks 106, 108 fixedly mounted on base 10.

Figure 5:
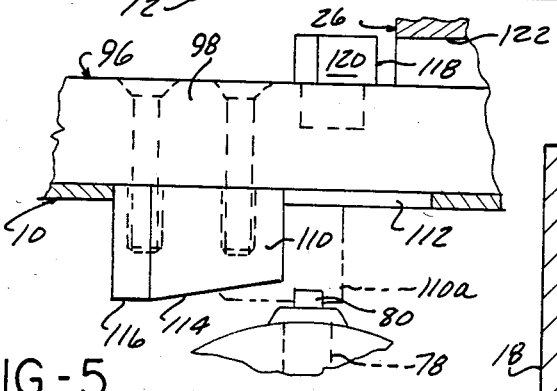
FIG. 5 is a detail side elevations of a portion of a valve actuator.
Figure 6:
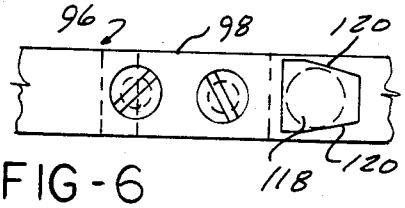
FIG. 6 is a top plan view of the structure shown in FIG. 5.

Referring now particularly to FIGS. 5 and 6, arm 98 of the actuator assembly 96 carries an air valve actuating cam 110 fixedly mounted on the underside surface of arm 98 and projecting downwardly through a slot 112 formed in the top of base 10. The lower surface of cam 110 is formed with a beveled section 114 and a flat section 116 as best seen in FIG. 5. Arm 98 and cam 110 are aligned with the actuator 80 of air valve 78 so that upon movement of the actuator to the right as viewed in FIG. 5, beveled surface 114 of the cam will engage and depress actuator 80 until the flat section 116 of the cam engages actuator 80 to position the air valve to connect air motor 72 to air supply 82. Rightward movement of actuator assembly 96 as viewed in FIG. 5 is limited by engagement of cam 110 with the right-hand end of slot 112, at which time flat surface 116 is engaged with valve actuator 80.

A similar, but reversed and offset cam, partially indicated in broken line at **110*a* is mounted on the underside of the opposite arm 100 of actuator assembly 96 to control actuation of the fluid control valve 84. The fluid control cam 110*a*, when actuator assembly 96 is in its normal position, shown in FIGS. 3 and 5, for example, is so located to hold the actuator 86 of valve 84 depressed to connect conduit 70 to the fluid reservoir 92 via conduit 94 (FIG. 4). Upon movement of actuator assembly 96 to the right as viewed in FIG. 5, cam 110*a* allows actuator 86 of the fluid control valve to elevate to disconnect conduit 70 from conduit 94 and to connect the output conduit 88 of pump 74 to conduit 70 as actuator assembly 96 arrives at its right-hand end limit of movement as viewed in FIG. 5**.

With actuator assembly 96 in its normal, withdrawn, position shown in FIGS. 1–3 and 5, the press is in its inoperative position, because air valve 78 is closed, thus cutting air motor 72 off from air supply 82 and fluid control valve 84 is positioned to connect conduit 70 to the fluid reservoir, thus allowing piston 42 to return to its normal rest position shown in FIG. 2 under the action of springs 46. To prevent inadvertent operation of the press when a die is not accurately aligned with piston 42, a fin-like safety locator tab 118 is fixedly mounted on the top of arm 98 of actuator assembly 96 (FIGS. 5 and 6). As best seen in the plan view of FIG. 6, tab 118 is formed with beveled surfaces 120 on its opposed sides.

Referring now to FIG. 5, when actuator assembly 96 is withdrawn to its normal rest position, tab 118 is clear of the side of die carrier 26 so that the die carrier may be shifted without interference from tab 118. Referring now to FIG. 4, it is seen that die carrier 26 is provided with two transverse slots 122 in its lower surface. Slots 122 are so located as to be aligned with tab 118 when one or the other of die nests 28 is located within cylinder 18. Unless one of the two slots 122 is located in alignment with tab 118, actuator assembly 96 cannot be moved forwardly from its withdrawn normal rest position far enough to shift either of valves 78 or 84, because the leading edge of tab 118 will collide with the side of die carrier 26. With a die nest located within cylinder 18, one of the two slots 122 will be located in alignment with the tab and forward movement of actuator assembly 96 will be permitted by virtue of the fact that tab 118 will move forwardly into slot 122. The beveled leading edges 120 of tab 118 will shift die carrier 26 as required to accurately align the die carrier with the piston prior to the shifting of valves 78 and 84 to cause air motor 72 to drive pump 74 to supply fluid under pressure to the top of cylinder 18 to drive piston 42 downwardly.

The press is specifically designed for manual operation and is particularly well adapted to the forming of embossed patterns on sheet metal blanks of gold or silver for use as jewelry components.

With the press parts in the position shown in FIG. 1, with actuator assembly 96 withdrawn to its normal position and the left-hand die carrier 28 exposed as in FIG. 1, the operator will manually load a workpiece blank onto the die 36 of the exposed die carrier. At this time, piston 42 will be in its normal elevated position shown in FIG. 1 because with actuator assembly 96 withdrawn, conduit 70 vents fluid from above piston 42 to fluid reservoir 92 via valve 84 and piston 42 is biased to the elevated position shown in FIG. 2 by springs 46.

With a blank loaded on the left-hand die, the operator manually shifts die carrier 26 to the right from the position shown in FIG. 1 to carry the now loaded die into cylinder 18 through opening 24 (FIG. 2) in the cylinder. Die carrier 26 is manually shifted to the right until stop block 30 engages the cylinder at the sides of opening 24. At this time, the die will be at least approximately aligned with piston 42 within the cylinder.

The operator then pushes actuator assembly 96 inwardly toward the cylinder. Tab 118 will enter slot 122 and its beveled leading edge will shift die carrier 26 laterally, if required, to accurately align die nest 28 with the bore 52 in piston 42.

When actuator 96 has been pushed inwardly to its actuating position, the air motor and fluid control valves 78 and 84 have been actuated by their respective cams to connect air motor 72 to the air supply and to connect the output of fluid pump 74 to conduit 70. Actuation of air motor 72 drives pump 74 which in turn supplies fluid under pressure to conduit 70 and thence to the upper end of cylinder 18 to apply pressure driving piston 42 downwardly. As best seen in FIG. 7, die nest 28 is slidably received within the counterbore 52 in the descending piston and the urethane pad 62 moves downwardly into engagement with the workpiece W on die 36 to apply substantial pressure to the workpiece to conform it to the pattern formed in the face of die 36.

While the pressing operation is being performed, the operator will manually load another workpiece onto the other die 36 which at this time will be exposed at the right-hand side of piston18 as viewed in FIG. 1. When the pressure applied to the workpiece reaches a selected pressure, as indicated by a pressure gauge 124 (FIG. 1), the operator pulls actuator assembly 96 back to its withdrawn normal rest position, thus causing the air and fluid control valves to shut off the air motor and shift the connection of conduit 70 from pump 74 to fluid reservoir 92. Connection of conduit 70 to fluid reservoir 92 permits piston 42 to return to its normal rest position under the action of springs 46, this upward movement of the piston discharging fluid from the top of cylinder 18 back into the fluid reservoir.

The operator then manually shifts die carrier 26 back to the position shown in FIG. 1, carrying the left-hand die with its formed workpiece out of the cylinder and at the same time moving the freshly loaded die into cylinder 18.

The foregoing cycle is then repeated.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

What is claimed is:

1. A press for pressing a relatively thin metal plate against a die face comprising a stationary base, a vertically disposed hydraulic cylinder fixedly mounted at its lower end upon said base, a piston slidably received within said cylinder, means biassing said piston to a normally maintained rest position adjacent the upper end of said cylinder, means defining a die receiving passage extending diametrically through the lower end of said cylinder, a die having an upwardly facing blank supporting die face and vertically extending side walls, die carrier means mounting said die upon said base for movement along a first fixed path extending through said passage to selectively locate said die in an inactive position outside of said cylinder and a ready position aligned with said cylinder, means defining a die receiving recess in the lower face of said piston extending upwardly into said piston to an upper end, said recess being adapted to slidably receive the side walls of said die, a resilient forming pad mounted within said piston at the upper end of said recess, fluid pressure supply means, and control means operable only when said die is in said ready position for conducting fluid under pressure from said supply means to the upper end of said cylinder to drive said piston downwardly from its rest position to cause said pad to press a blank located upon said die face against said die face, said control means comprising a manually movable valve actuator mounted on said base for movement from an off position to an on position to establish a fluid connection between said supply means and the upper end of said cylinder, and abutment means mounted on said manually movable actuator operable to mechanically block said movement to said on position unless said die is in said ready position.

2. The invention defined in claim 1 wherein said abutment means comprises means guiding said actuator for movement relative to said base along a second fixed path normal to said first fixed path, a tab fixed to and projecting from said actuator, and means defining a slot in said carrier extending in a direction normal to said first fixed path and located to slidably receive said tab when said die is in said ready position.

3. A press for pressing a relatively thin metal blank against a die face comprising a stationary base, a vertically disposed hydraulic cylinder fixedly mounted on its lower end upon said base, a piston slidably received within said cylinder, means biassing said piston upwardly to a normally maintained rest position at the upper end of said cylinder, means defining a die receiving passage extending diametrically through the lower end of said cylinder, an elongate die carrier slidably mounted upon said base extending through and projecting from the opposite ends of said passage, a pair of dies fixedly mounted upon said carrier at longitudinally spaced positions such that when one of said dies is located within said cylinder the other of said dies is located outside of said cylinder, each of said dies having vertically extending side walls projecting upwardly from said carrier and an upwardly facing blank supporting die face, stop means on said carrier engageable with said cylinder to establish a first end limit of movement of said die carrier wherein one of said dies is located within said cylinder and an opposite end limit of movement of said die carrier wherein the other of said dies is located within said cylinder, fluid pressure supply means in fluid communication with the upper end of said cylinder above said piston operable when actuated to supply fluid under pressure to the upper end of said cylinder to drive said piston downwardly from said rest position, said piston having a die receiving recess in its lower end adapted to slidably receive a die, a resilient forming pad in said recess movable into engagement with a blank supported upon the die face of a die located within said cylinder upon downward movement of said piston, and control means operable to actuate said supply means when either of said dies is positioned within said cylinder beneath said piston, said fluid supply means comprising means defining a fluid reservoir, pump means having an intake connected to said reservoir, a fluid conduit in fluid communication with the upper end of said cylinder valve means operable in a first position to connect said conduit to said reservoir and operable in a second position to connect said conduit to receive fluid under pressure from said pump means, and drive means operable when actuated to drive said pump means, and wherein said control means comprises a manually movable actuator member mounted on said base for movement between an off position and an on position, means on said actuator member operable upon movement of said actuator member from said off position to said on position to shift said valve means from said first position to said second position and to simultaneously actuate said drive means, and means on said actuator member engageable with said die carrier for preventing movement of said actuator member from said off position to said on position unless said die carrier is at one of its end limits and for preventing movement of said die carrier away from either of said end limits when said actuator member is in its on position.

4. A press for pressing a relatively thin metal plate against a die face, said press comprising base plate means having a flat a horizontal upper surface, a manually movable elongate rectangular carrier plate slidably mounted on said upper surface for reciprocatory movement between a first and a second end limit of longitudinal movement relative to said base plate means, a pair of vertically disposed cylindrical die means fixedly mounted upon the top of said carrier plate at longitudinally spaced positions and each having an upwardly facing die face recessed into its upper end positions, a vertically disposed hydraulic cylinder open at it slower end fixedly mounted upon and projecting upwardly from the upper surface of said base plate means, means defining a die passage extending diametrically through the lower end of said cylinder, said passage having opposed side walls slidably engaging the opposite side edges of said carrier plate to guide said carrier plate in movement between said first and second end limits, said die means being longitudinally spaced from each other such that when one of said die means is coaxially aligned with said hydraulic cylinder the other of said die means is accessible at the exterior of said hydraulic cylinder, a piston slidably received within said cylinder and having a cylindrical die means receiving recess in its lower face extending axially upwardly into said piston to an upper end, a resilient forming pad mounted within said recess and projecting axially downwardly from its upper end, means normally biassing said piston to an elevated rest position within said cylinder clear of the path of movement of said die means through said passage, fluid pressure means operable when actuated to drive said piston downwardly from said rest position, manually operable control means mounted on said base plate means for actuating said fluid pressure means upon movement of said control means from an off position to an on position, and abutment means on said control means and engageable with and said carrier plate for blocking movement of said control means from said off position to said on position unless one of said die means is coaxially aligned with said hydraulic cylinder and operable when said control means is in said on position to lock said carrier plate against movement relative to said base plate means.

5. The invntion defined in claim 4 wherein said controlmeans comprises defining a slot in the upper surface of said base plate means in a direction normal to the path of reciprocatory movement of said carrier plate, a slide member slidably received in said slot, means defining a first and a second slot in said carrier plate extending transversely across the bottom of said carrier plate from one longitudinal side edge to the other, and said abutment means comprises a fin-like abutment member fixedly mounted upon and projecting upwardly from said slide member adapted to be slidably received within either one of said first and second slots in said carrier plate.

6. The invention defined in claim 4 further comprising first and second stop blocks fixedly mounte dupon and extending transversely across the top of said carrier plate between each respective longitudinal end of said carrierp late and the adjacent die means, said stop blocks having a transverse width greater than that of said die passage to respectively establish said first and second end limits of movement of said carrier plate by the engagement between a stop block and said hydraulic cylinder, and a protective block fixedly mounted upon and extending transversely across the top of said carrier plate between said die means, said protective block and said stop blocks being spaced from each other longitudinally of said carrier plate such that when said carrier plate is at either of its end limits of movement the opposite ends of said die passage are substantially closed respectively by said protective block and one of said stop blocks.

* * * * *